United States Patent [19]

Wade

[11] 4,034,235

[45] July 5, 1977

[54] CIRCUITS

[75] Inventor: Kenneth Robinson Wade, Parbold, England

[73] Assignee: Product Automation and Control Limited, England

[22] Filed: Dec. 22, 1975

[21] Appl. No.: 643,058

[52] U.S. Cl. ..... 307/117; 340/228.1; 431/25; 431/6; 328/6

[51] Int. Cl.[2] ..... H01H 47/26

[58] Field of Search ..... 307/117; 340/227 R, 340/228.1; 317/157, 133.5; 431/69, 25, 24, 6, 78; 328/6

[56] References Cited

UNITED STATES PATENTS 3,671,815 6/1972 Eberle et al. ..... 340/228.1

*Primary Examiner*—Herman J. Hohauser
*Attorney, Agent, or Firm*—Beveridge, De Grandi, Kline & Lunsford

[57] ABSTRACT

This invention relates to a circuit for monitoring the presence of a flame of a gas burner, comprising a probe means connectible to a source of alternating signal and locatable in a combustion area of the flame for applying said alternating signal across the area for rectification by the flame when the flame is present, second means operably coupled to said probe means for providing a second alternating signal in dependence upon the generation of the rectified signal, and switch means connected to receive said second alternating signal and operable for switching from a first to a second state for a preset period of time responsively to reception of the second alternating signal.

13 Claims, 3 Drawing Figures

CIRCUITS

The present invention relates to circuits and in particular to circuits for monitoring the presence of a flame of a gas burner and controlling a supply of gas to the burner in dependence upon the presence of the flame.

Presently used monitoring circuits utilise the rectifying properties of the flame of a gas burner to provide a d.c. signal from an a.c. supply, the d.c. signal then being used to control a valve in a gas supply line of the burner. The valve is automatically closed when the flame is extinguished. However, component failure in the monitoring circuits may result in the circuits behaving as if the flame were permanently present, even when the flame is extinguished, with obvious, dangerous results.

To overcome this problem complex "fail-safe" systems have been added to such monitoring circuits. These "fail-safe" circuits have the disadvantage that they add considerable cost to the monitoring circuits and, of course, are prone to failure themselves.

An object of the present invention is to provide a method and a circuit which is both cheap to produce and simple in construction.

A further object of the present invention is to provide a timing circuit which may advantageously be used with the above circuit.

In accordance with one aspect of the present invention there is provided a method for monitoring the presence of a flame of a gas burner, comprising, applying an alternating signal across a combustion area of the flame for rectification by the flame when the flame is present, deriving a second alternating signal from the rectified signal and utilising the second alternating signal to indicate the presence of the flame.

In accordance with a second aspect of the present invention there is provided a circuit for monitoring the presence of a flame of a gas burner, comprising a probe means connectible to a source of alternating signal and locatable in a combustion area of the flame for applying said alternating signal across the area for rectification by the flame when the flame is present, second means operably coupled to said probe means for providing a second alternating signal in dependence upon the generation of the rectified signal, and switch means connected to receive said second alternating signal and operable for switching from a first to a second state for a preset period of time responsively to reception of the second alternating signal.

Preferably, the first-mentioned means comprises a switch coupling the probe means to the switch means, the switch being drivable alternately on and off for converting the rectified signal on the probe means to said second alternating signal.

Advantageously, the switch comprises a transistor drivable by a third alternating signal.

Conveniently the switch means comprises a relay whose release time is such that it remains energised during reception of the second alternating signal.

Accordingly the present invention also provides a circuit for controlling a gas valve in dependence upon the presence of a flame comprising control means energisable for opening said valve; trigger circuit actuable to energise said control means for a preset period of time; and switch means for switching from a first to a second switched state in dependence upon the presence of said flame and wherein said switch means is connectible to a source of electric power, is electrically connected to said trigger circuit in said first switched state for connecting said trigger circuit to said power source, and is electrically connected to said control means in said second switched state for connecting said power source to said control means thereby to energise said control means.

The invention is further described hereinafter by way of example, with reference to the accompanying drawings, in which.

Figure 1:
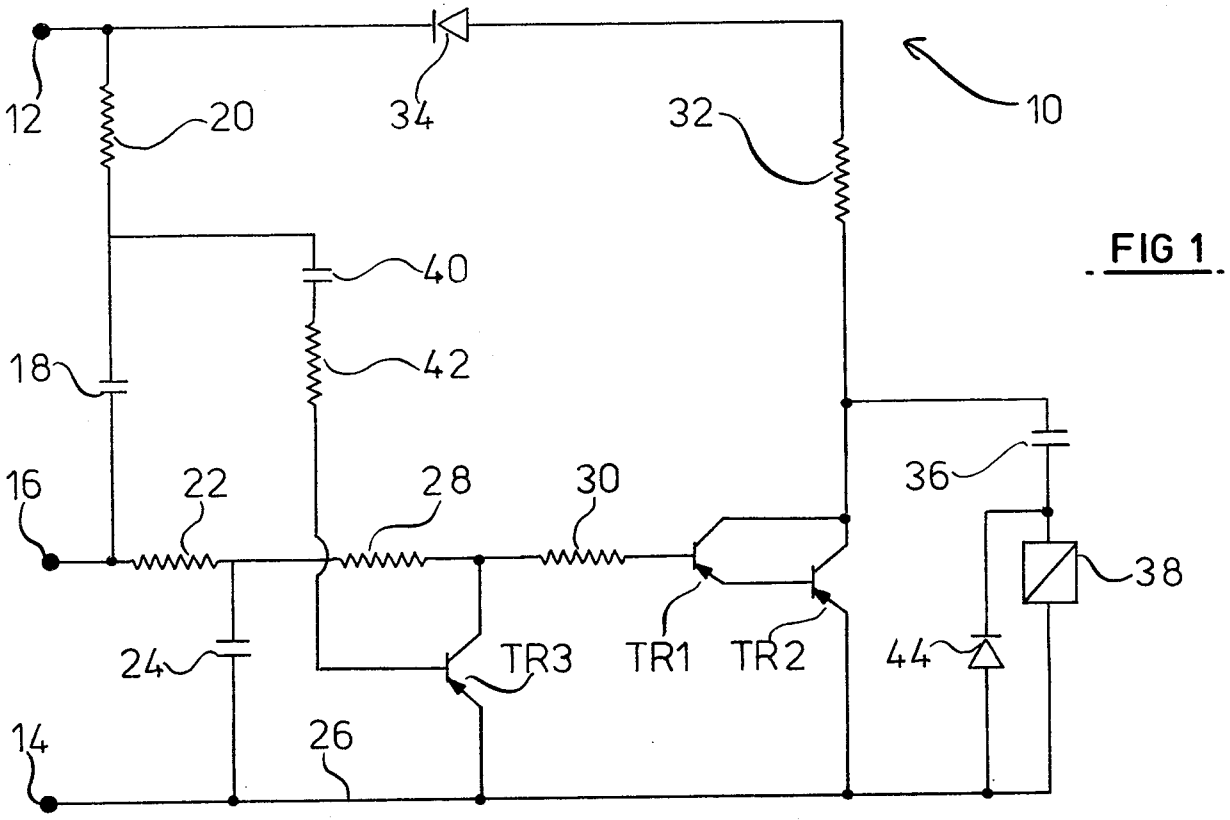
FIG. 1 shows one embodiment of a monitoring circuit in accordance with the invention.

The monitoring circuit 10 of the drawing has two inputs 12 and 14 for connection to line and neutral terminals respectively of an alternating signal power source (not shown). The alternating signal e.g. between 200 and 240 volts a.c. from the power source is applied to a flame probe 16 of the circuit 10 by way of a series combination of a capacitor 18 and a resistor 20 connected between the probe 16 and the input 12.

Because of ionisation which occurs within an area of combustion of a flame the latter acts as a poor diode having a forward resistance of typically 10 megohms and a reverse resistance of typically between 50 and 100 megohms.

When the flame probe 16 is located within the area of combustion of a flame of e.g. a pilot gas burner (not shown), the flame acts to rectify the alternating signal applied to the probe 16.

Since the gas burner is usually metal and earthed a rectified or d.c. signal will be developed across the probe 16 and earth, and hence across the probe 16 and the neutral input 14 of the circuit 10.

During a positive half-cycle of the applied alternating signal the flame exhibits a low resistance and conducts to earth whereas during a negative half-cycle the flame exhibits a high resistance, thus resulting in a net negative polarity signal on the probe 16 when the flame is present. This net negative signal is smoothed by a resistor 22 connected to the probe 16 and a capacitor 24 connected between the free terminal of the resistor 22 and a neutral line 26 which is connected to the terminal 14.

The smoothed negative rectified signal is applied to the base of a p-n-p transistor TR1 by way of a series combination of two resistors 28 and 30 connected between the base of the transistor TR1 and the junction of the resistor 22 and the capacitor 24.

The transistor TR1 is connected to a second p-n-p transistor TR2 to form a Darlington circuit, the emitter of the transistor TR2 being connected to the line 26. The two collectors of the transistors TR1, TR2 are joined together and connected both by way of a series combination of a resistor 32 and diode 34 to the terminal 12, and by way of a series combination of a capacitor 36 and a solenoid 38 of a relay (not shown) to the line 26. The relay is used, for example, to control a voltage supply line of a solenoid valve (not shown) in a main burner gas line (not shown) of the gas burner, or in the pilot burner gas line. In the latter case an ignition circuit which can override the circuit of FIG. 1 must be provided to enable opening of the valve in the pilot burner line for ignition purposes.

The junction of the resistor 20 and the capacitor 18 is connected by way of a series combination of a capacitor 40 and a resistor 42 to the base of p-n-p transistor TR3 whose collector is connected to the junction of the resistor 28 and 30 and whose emitter is connected to the line 26.

A diode 44 is connected in parallel with the solenoid 38 to complete a charging path for the capacitor 36.

The further operation of the circuit is described hereinafter. With no flame present, no negative signal is applied to the base of the transistor TR1 and hence the transistor TR1 and TR2 are non-conducting and capacitor 36 charges up by way of the diode 34, the resistor 32 and the diode 44.

When a flame is present, the negative signal applied to the base of the transistor TR1 turns the latter, and thus transistor TR2, on. A positive going pulse is thus applied to the junction of the capacitor 36 and the resistor 32 by the action of the Darlington circuit and, since the capacitor 36 cannot discharge instantaneously a positive going pulse also appears at the junction of the capacitor 36 and the solenoid 38. The diode 44 is thus reverse biassed and the capacitor 36 forced to discharge by way of the collector-emitter path of the transistor TR2 and the solenoid 38, the relay thus being actuated while the capacitor 36 discharges.

However, the transistor TR3 is driven by way of the resistor 20 and 42 and the capacitor 40 by the alternating signal applied across the inputs 12 and 14. The transistor TR3 thus conducts during each negative half-cycle of the applied alternating signal to remove the rectified signal applied to the base of the transistor TR1, the result being a pulsed d.c. signal applied to the transistor TR1.

The transistor TR2 is thus turned off during each negative half-cycle, allowing the capacitor 36 to charge by way of the diodes 34 and 44 and the resistor 32.

During each positive half-cycle the transistor TR2 again conducts allowing the capacitor 36 to discharge through the solenoid 38.

In practice, the release time of the relay is longer than the duration of each negative half-cycle so that the relay remains energised while the flame is present.

The operating requirement that each of the transistors TR1, TR2 and TR3 switches between conducting and non-conducting states each half-cycle means that the circuit 10 is to some extent self-monitoring i.e. in the event of a component failure which results in a failure of the circuit 10 to apply pulses across the solenoid 38, the latter will be de-energised. When the relay controls a voltage supply line of a solenoid valve in a gas line of the gas burner, de-energisation of the relay results in the closing of the solenoid valve, thus drawing attention to a failure in the circuit 10 and shutting off the gas supply.

A failure of any one of the transistors TR1, TR2 and TR3 will result in a deenergisation of the relay.

Figure 2:
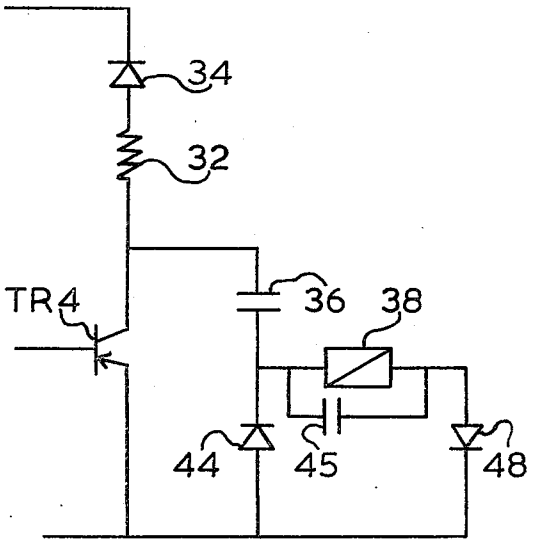
FIG. 2 shows a modification of a portion of FIG. 1.

FIG. 2 shows a modification of a part of the circuit of FIG. 1 which overcomes the need to rely on the relase time of the relay being longer than a half cycle of the applied alternating signal. An additional capacitor 45 is connected in parallel with the solenoid 38 which is connected to the line 26 by a diode 48, the anode of the diode being connected to the solenoid 38. The capacitor 45 holds the solenoid 38 energised during the negative half cycles. The transistor TR4 can replace the Darlington configuration of TR1 and TR2 or can be equivalent to TR2.

Figure 3:
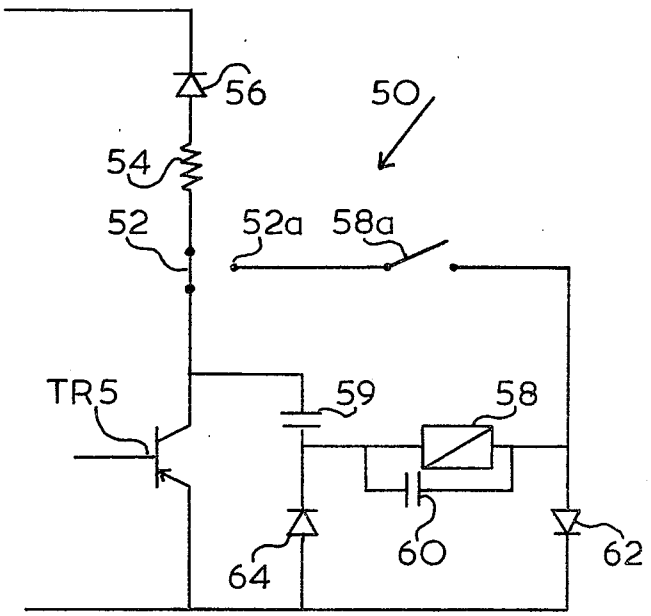
FIG. 3 shows a timing circuit suitable for use with the circuit of FIG. 1.

FIG. 3 shows a timing circuit 50 which advantageously can be used with the flame sensing circuit of FIG. 1 or 2. The timing circuit 50 has a transistor TR5 whose collector is connected via a normally closed contact pair 52 of the contacts of a make/break relay (not shown) and a series combination of a resistance 54 and a diode 56 to an a.c. voltage source. A d.c. supply can alternatively be used and the diode 56 omitted. The base of the transistor TR5 is connected to a circuit such as a conventional push-button actuated circuit which when actuated turns the transistor TR5 on for a set period. Alternatively the circuit of FIG. 1 or FIG. 2 can be used with TR5 replacing TR2 or TR1 and TR2 and a rectifier replacing the probe terminals 14 and 16. The transistor TR5 would then be turned on alternate half cycles to energise a relay 58 which controls, for example, a valve in a gas line of a pilot burner (not shown). The relay 58 is connected in series with a capacitor 59 and a diode 62 and in parallel with a capacitor 62 in a similar manner to the relay 38 of FIG. 2. The capacitor 59 and TR5; serve as a trigger circuit for the relay 58. A diode 64 is also connected in parallel with the capacitor 60 and the diode 62.

The contacts 52 can be controlled by a flame sensing circuit such as FIG. 1.

When the circuit of FIG. 3 is first energised the capacitor 59 charges to approximately the d.c. supply voltage and although this charging time can be made relatively short TR5 can be prevented from being turned on during this charging time by a suitable delay or inhibit circuit (not shown in the drawings). When it is desired to ignite the pilot burner after capcitor 59 has fully charged, transistor TR5 is turned on. The transistor TR5 thus shorts the capacitor 59 to earth, applying a pulse across the relay 58 which energises and closes the contacts **58*a*, opens the pilot gas valve and actuates an ignition means e.g. a spark. If the pilot burner is ignited during the time (conveniently between 3 seconds and 25 seconds although this range can be extended) the relay 58 is held on by the capacitor 59 discharging through the relay 58, the flame sensing circuit which controls the contacts 52 senses the pilot flame and switches the voltage supply for the transistor TR5 and capacitor 59 by way of a further contact 52*a* to the relay 58 which is thus maintained by virtue of its closed contacts 58*a* in a self latched mode and is permanently energised while the pilot is lit and the flame sensing circuit is operating correctly. If the pilot flame is extinguished the contact pair 52 close, deenergising the relay 58, closing the pilot gas valve, and reconnecting the voltage source to the transistor TR5 and the capacitor 59**. To open the pilot gas valve again the transistor TR5 must be turned on once more.

The operation of the circuit of FIG. 3 relies upon a pulsed signal being applied to the relay 58 so that, in the event of either a short-circuit or open circuit of the transistor TR5 or failure of the capacitor 59 the relay 58 will not become permanently energised in the absence of a sensed pilot flame. The circuit of FIG. 3, therefore, provides a measure of safety in its application to the control of gas lines and can of course be used in other applications where a measure of safety is preferred, particularly in the control of fuel lines where the contacts 52, **52*a*** can be controlled by means which monitor e.g. fuel leaks.

I claim:

1. A flame detection circuit comprising probe means connectible to a source of alternating signal and locatable in a combustion area of a flame to apply said alternating signal across the flame for rectification thereby; first semiconductor switch means connected to said probe means and triggerable by said alternating signal to convert the rectified signal into a pulsed signal; a capacitance connectible to a source of direct current signal to be charged thereby; relay means connected to said capacitance; and second switch means actuable by each pulse of said pulsed signal to discharge said capacitance through said relay means whereby to actuate said relay means.

2. A circuit for monitoring the presence of a flame of a gas burner, comprising a probe means connectible to a source of alternating signal and locatable in a combustion area of the flame for applying said alternating signal across the area for rectification by the flame when the flame is present, second means operably coupled to said probe means for providing a second alternating signal in dependence upon the generation of the rectified signal, and switch means connected to receive said second alternating signal and operable for switching from a first to a second state for a preset period of time responsively to reception of the second alternating signal.

3. A circuit as claimed in claim 2 wherein the second means comprises a switch coupling the probe means to the switch means, the switch being drivable alternately on and off for converting the rectified signal on the probe means to said second alternating signal.

4. A circuit as claimed in claim 3 wherein the switch comprises a transistor drivable by a third alternating signal.

5. A circuit as claimed in claim 2 wherein the switch means comprises a relay energisable responsively to reception of each alternate half cycle of said second signal and wherein said preset period is at least equal to each half cycle period.

6. A circuit as claimed in claim 3 wherein the switch means comprises a relay energisable responsively to reception of each alternate half cycle of said second signal and wherein said preset period is at least equal to each half cycle period.

7. A circuit as claimed in claim 4 wherein the switch means comprises a relay energisable responsively to reception of each alternate half cycle of said second signal and wherein said preset period is at least equal to each half cycle period.

8. A circuit for controlling a gas valve in dependence upon the presence of a flame comprising control means energisable for opening said valve; a trigger circuit actuable to energise said control means for a preset period of time; probe means connectible to a source of alternating electric power and locatable in a combustion area of the flame for applying said alternating electric power across the combustion area for rectification by the flame when the flame is present to provide a rectified signal; and switch means for switching from a first to a second switched state in dependence upon the presence of said rectified signal; and wherein said switch means is connectible to said source of alternating electric power, is electrically connected to said trigger circuit in said first switched state for connecting said trigger circuit to said source of alternating electric power, and is electrically connected to said control means in said second switched state for connecting said source of alternating electric power to said control means thereby to energise said control means.

9. A circuit as claimed in claim 8 wherein said control means comprises a relay.

10. A circuit as claimed in claim 9 wherein said trigger circuit is a transitor coupled to a solenoid of the relay by way of a capacitor.

11. A circuit as claimed in claim 8 wherein said trigger circuit comprises a transistor, the control means comprises a relay having a solenoid and said relay is connected in a self latching mode having a pair of contacts coupling the relay solenoid to said switch means, and further comprising a capacitor coupling a collector of the transistor to said solenoid.

12. A circuit for controlling a gas valve in dependence upon the presence of a flame comprising a probe means connectible to a source of alternating signal and locatable in a combustion area of the flame for applying said alternating signal across the area for rectification by the flame when the flame is present; second means operably coupled to said probe means for providing a second alternating signal in dependence upon the generation of the rectified signal; switch means connected to receive said second alternating signal and operable for switching from a first to a second state for a preset period of time responsively to reception of the second alternating signal; control means energisable for opening said valve and a trigger circuit actuable to energise said control means for a preset period of time; and wherein said switch means is connectible to a source of electric power, is electrically connected to said trigger circuit in said first switched state for connecting said trigger circuit to said power source, and is electrically connected to said control means in said second switched state for connecting said power source to said control means thereby to energise said control means.

13. A circuit for monitoring the presence of a flame of a gas burner, comprising probe means connectible to a source of alternating electrical signal and locatable in a combustion area of the flame for applying said alternating electrical signal across the combustion area for rectification by the flame when the flame is present to provide a rectified signal; second means coupled to said probe means and connectible to the source of alternating electrical signal for generating a second alternating signal in response to the rectified signal; first switching means connected to said second means and in response to said second alternating signal continuously switching between first and second switching states; and second switching means connected to said first switching means, said second switching means normally assuming a first switching condition but responsive to the switching of said first switching means between said first and second switching states to assume a second switching condition.

* * * * *

UNITED STATES PATENT OFFICE

CERTIFICATE OF CORRECTION

Patent No. 4,034,235 Dated July 5, 1977

Inventor(s) Kenneth Robinson Wade

It is certified that error appears in the above-identified patent and that said Letters Patent are hereby corrected as shown below:

Assignee should read:

-- Pactrol Controls Limited --.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*